US008672044B2

(12) United States Patent
Fabre

(10) Patent No.: US 8,672,044 B2
(45) Date of Patent: Mar. 18, 2014

(54) DEVICE FOR INCREASING THE EFFECTIVENESS OF THE PRESSURIZING GAS IN AN EXTINGUISHER BOTTLE

(71) Applicant: Christian Fabre, Tournefeuille (FR)

(72) Inventor: Christian Fabre, Tournefeuille (FR)

(73) Assignee: Airbus Operations SAS, Toulouse (FR)

( * ) Notice: Subject to any disclaimer, the term of this patent is extended or adjusted under 35 U.S.C. 154(b) by 0 days.

(21) Appl. No.: 13/662,069

(22) Filed: Oct. 26, 2012

(65) Prior Publication Data

US 2013/0048316 A1 Feb. 28, 2013

Related U.S. Application Data

(62) Division of application No. 11/720,665, filed as application No. PCT/FR2005/051039 on Dec. 6, 2005, now Pat. No. 8,322,452.

(30) Foreign Application Priority Data

Dec. 9, 2004 (FR) ..... 04 52912

(51) Int. Cl.

| | |
|---|---|
| ***B67D 7/60*** | (2010.01) |
| ***B65D 83/00*** | (2006.01) |
| ***A62C 35/00*** | (2006.01) |

(52) U.S. Cl.

USPC ..... 169/8; 169/9; 169/20; 222/386; 222/394; 222/399

(58) Field of Classification Search

USPC ..... 169/8, 9, 20; 222/386, 394, 399, 386.5

See application file for complete search history.

(56) References Cited

U.S. PATENT DOCUMENTS

| | | | |
|---|---|---|---|
| 1,235,550 | A | 8/1917 | Carmody |
| 3,494,513 | A | 2/1970 | Bauer |
| 3,790,038 | A | 2/1974 | Kifer |
| 4,877,051 | A | 10/1989 | Day |
| 5,582,254 | A | 12/1996 | Pistek |
| 5,664,631 | A | 9/1997 | Szocs |
| 5,845,716 | A | 12/1998 | Birk |
| 5,984,016 | A | 11/1999 | Samuelsson |
| 6,138,766 | A | 10/2000 | Finnerty et al. |
| 6,375,047 | B1 | 4/2002 | Herda et al. |
| 7,735,571 | B2 | 6/2010 | Fabre |
| 8,020,628 | B2 | 9/2011 | Fabre et al. |

FOREIGN PATENT DOCUMENTS

| | | |
|---|---|---|
| DE | 102 31 740 B3 | 4/2004 |
| EP | 0 711 578 A2 | 5/1996 |
| WO | WO 93/25950 | 12/1993 |
| WO | WO 98/02211 | 1/1998 |

*Primary Examiner* — Justin Jonaitis

(74) *Attorney, Agent, or Firm* — Oblon, Spivak, McClelland, Maier & Neustadt, L.L.P.

(57) ABSTRACT

A fire extinction device comprises a reservoir (2) of extinguishing agent and means for generating a pressurized gas (30) such that the gas generated (16) may enter the reservoir (2) when the extinguishing agent (4) is to be ejected onto a fire zone.

The device of the invention comprises furthermore a refractory separating element (40) between the extinguishing agent (4) and the pressurizing gas generated (16), in order to avoid heat exchanges between them and to optimise the ejection of the extinguishing agent (4).

14 Claims, 3 Drawing Sheets

DEVICE FOR INCREASING THE EFFECTIVENESS OF THE PRESSURIZING GAS IN AN EXTINGUISHER BOTTLE

CROSS-REFERENCE TO RELATED APPLICATIONS

This application is a division of U.S. application Ser. No. 11/720,665, filed Jun. 1, 2007, the entire contents of which are incorporated herein by reference. U.S. application Ser. No. 11/720,665 is a national stage of PCT FR05/51039, filed Dec. 6, 2005, PCT FR05/51039 is based upon and claims the benefit of priority from prior French Application No. FR 0452912 filed Dec. 9, 2004.

DESCRIPTION

1. Technical Field

The invention relates to fire fighting appliances, in other words extinguishers. More especially, the invention has an application in fire extinguishing devices in which the extinguishing agent is expulsed from its reservoir by the external generation of a pressurised gas.

In one aspect, the invention relates to a device located in an extinguisher reservoir that permits the improvement of the efficiency of the pressurisation gas generated and introduced in the reservoir when the extinguisher agent is to be ejected onto a fire zone.

2. State of the Prior Art

It is known that extinguishers with reservoirs containing extinguishing agents are classified in two main categories. The first category relates to appliances that are permanently pressurised in which a gas provides the permanent pressurisation of the extinguishing agent in a single bottle that acts as the reservoir; the extinguishing agent is freed by a valve at the outlet of said cylinder. In the second category, a propelling gas is only freed once the extinguisher is put into use and frees the extinguishing agent, which is consequently not stored under pressure.

By way of illustration of the first type of extinguisher, we can consider the extinguishers currently used to put out a fire on an aeroplane engine. These devices, which use halon as their extinguishing agent, not only permit the fire to be extinguished but also prevent any spreading of said fire. The extinguishing agent is contained in a bottle, which in most cases is spherically shaped, pressurised by an inert gas; one or more distribution channels, connected to said bottle, permits the agent to be distributed to the zones to be protected. At the lower end of the bottle, a calibrated cap permits each distribution channel to be sealed. A pressure sensor is also installed in order to check, continuously, the pressurisation of the bottle. When a fire is detected, a pyrotechnic detonator is triggered. The resulting shock wave permits the cap to be pierced, which causes the bottle to be emptied and the extinguishing agent to be evacuated due to the effect of the pressure contained in the bottle to the zones to be protected, via the channels.

One major disadvantage of this type of pressurised extinguisher is their sensitivity to micro-leaks, which subjects them to severe monitoring, verification and maintenance conditions. Furthermore, the extinguishing agent does not fill the cylinder completely as it has to hold the pressurising gas.

As concerns the extinguishers of the second category, they use a separate pressurising device. These fire fighting appliances are generally equipped with a first reservoir of compressed gas and a second reservoir for the extinguishing agent. When the appliance is used, the compressed gas contained in the first reservoir is brought into communication with the second reservoir containing the extinguishing agent by means of an orifice, to pressurise the cylinder containing the extinguishing agent. When the extinguishing agent is pressurised, it is ejected to fight the fire, as for the appliances of the first category of extinguisher.

In some cases, for the generators of the second category, the first reservoir of compressed gas may be replaced by a gas generator, as described in the document WO 98/02211.

However, the performances of such extinguishers can still be greatly optimised. Indeed, some extinguishing agents can rapidly absorb the calories of the generated propelling gas, which leads to a reduction in the pressure in the reservoir. In particular, in the case of a propergol-type pyrotechnic material being used in an extinguisher used on an aeroplane, the temperature of the extinguisher components can reach approximately 55° C. below zero, due to the high altitude at which the aeroplane flies.

To compensate the loss in efficiency resulting from excessive absorption of the calories of the propelling gas, it is certainly possible to increase the instantaneous volume of the generated gas, which is to say, depending on the means used, to increase the volume or the number of reservoirs of pressurised gas, or even the quantity of pyrotechnic material. These solutions are detrimental to the volume and also to the weight; whereas these factors are important in all uses, and are even primordial in the case of aeroplanes, especially as concerns the extinction of engine fires.

DESCRIPTION OF THE INVENTION

The invention proposes to improve the efficiency of an extinguisher whilst overcoming these disadvantages. More particularly, the invention permits the increase in volume and weight of the means for generating a pressurised gas to be reduced or eliminated, whilst conserving optimal expulsion of the extinguishing agent and limiting the absorption of calories. In particular, the invention concentrates on the heat exchanges and reducing them, an aspect that is not taken into consideration in the extinguishers of the prior art.

In one aspect, the invention relates to a fire extinguishing device comprising a reservoir in which is stored an extinguishing agent, means for generating a propelling gas and means for bringing the reservoir into communication with the means for generating the propelling gas. The propelling gas can thus penetrate the reservoir in order to eject the extinguishing agent.

Advantageously, the reservoir of the extinction device of the invention is connected, preferably close to the point where the agent accumulates, to a system for distributing the extinguishing agent to the zones to be dealt with and the means for establishing the communication are, in general although not restrictively, located at a point that is substantially opposite the point of accumulation. Means of sealing the reservoir prevent the extinguishing agent from flowing into the distribution system in the absence of pressure in said reservoir; the means can consist of a valve that is opened during the triggering sequence of the extinguisher, or in a leak proof cap calibrated to break under the pressure.

Furthermore, the device comprises a separating element that avoids direct communication between the gas generated and the extinguishing agent and which limits the absorption of calories from the gas generated by the extinguishing agent. In this way, the generated gas exerts maximum pressure in the reservoir. The separating element is refractory, which is to say that it has low heat conductivity; it is located downstream of the communication means, advantageously in the reservoir, preferably at the surface of the extinguishing agent.

The separating element can separate the reservoir into two leak proof parts; it is also possible that the separating element comprises passages that bring the two parts into direct communication, simply in order to reduce significantly the contact surface between pressurising gas and extinguishing agent.

Thanks to the separating element, there is little or no heat exchange between the propelling gas and the extinguishing agent, which permits the pressure in the reservoir to be kept intact. Consequently, it is no longer necessary to increase, due to the reason of heat exchange, the volume or the number of pressurised gas reservoirs or even the quantity of pyrotechnic material.

The separating element, or the interface between extinguishing agent and pressurising gas, may consist of a rigid plate, advantageously made from a material capable of withstanding the stresses associated to the contact with the pressurising gas, and mobile, in order to transmit the pressure to the extinguishing agent.

Such a plate may be solid, or may consist of a grill, with passages that reduce the direct contact surface between the pressurising gas and the extinguishing agent.

In another embodiment, the interface between extinguishing agent and pressurising gas is composed of a flexible membrane, which also separates the reservoir into two parts. The membrane may be mobile, or fixed to the periphery of the reservoir, depending on its elasticity.

The separating element of the invention may comprise opening means that permit the pressurising gases to be evacuated when the reservoir is empty. For example, a fusible cap may be positioned so that, when the extinguishing agent has been ejected, the protective cap is positioned opposite the ejection orifice of the distribution means, and opens due to the resulting difference in pressure.

BRIEF DESCRIPTION OF THE DRAWINGS

The figures of the appended drawings will allow a better understanding of the invention, but are only provided by way of illustration and are in no way restrictive.

DETAILED DESCRIPTION OF SPECIFIC EMBODIMENTS

Figure 1:
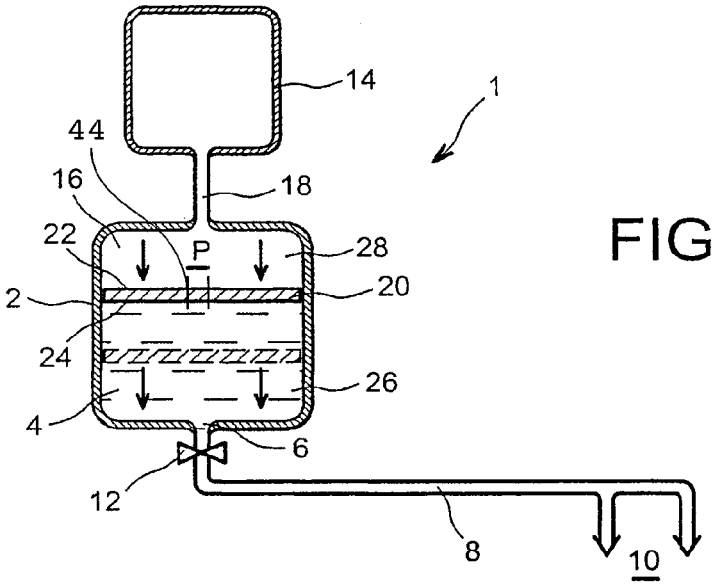
FIG. 1 shows one embodiment of an extinction device of the invention.

As shown by FIG. 1, an extinction device, or extinguisher, 1 comprises a bottle 2 that acts as the reservoir for the extinguishing agent 4; the bottle is preferably at ambient pressure. The invention applies more particularly to an extinguishing agent 4 in liquid form; in particular, the extinguishing agent 4 may have a very low saturating vapour tension (close to that of a solvent) and be present in liquid state, especially in the temperature range that is of interest to the aeronautical application.

The bottle 2 comprises one or more outlet orifices 6, which may be coupled to distribution ducts 8, to permit the extinguishing agent 4 to be ejected to a zone to be treated 10. Preferably, the outlet orifices 6 are located on the side where the extinguishing agent 4 accumulates, which is to say, in general, towards the bottom of the bottle 2. Advantageously, each outlet orifice 6 is closed by a closing device 12 in order to keep the extinguishing agent in the bottle 2 until it is needed. In particular, if there is a single orifice 6, the sealing device 12 may for example be a calibrated cap, which is to say a membrane that breaks or opens when the pressure inside the bottle 2 reaches a certain threshold. The sealing device 12 may also be a valve, advantageously controlled remotely. Other sealing devices 12 are known for example in WO 93/25950 or U.S. Pat. No. 4,877,051, and are available in the market.

Furthermore, the extinction device 1 comprises means for generating a pressurised gas 14. The means 14 for generating a pressurised gas 16 are connected to the extinguishing agent cylinder 2 via the communication means 18. Advantageously, the communication means 18 between the reservoir of the extinguishing agent 2 and the means of generating a pressurised gas 14 open into the reservoir 2 opposite the outlet orifice 6.

The means 14 for generating a pressurised gas may, in the embodiment of the invention shown in FIG. 1, consist of one or more reservoirs of pressurised gas. In this case, a valve in the communication means 18 permits for example the reservoir of pressurised gas 14 to be isolated from the extinguisher 2 as long as the latter is not used; other solutions are also possible.

Given the contact surface, the extinguishing agent 4 can absorb the calories of the propelling gas generated when the communication means 18 are opened, initiated if needed in the fire zone 10. As the pressurised gas drops in temperature, in parallel there is a drop in the pressure P in the reservoir 2. To limit the heat exchanges between the two phases of the invention, a separating element 20 is present.

The separating element, in this embodiment, comprises a rigid plate 20 that is mobile in the reservoir of the extinguishing agent 2 such that it provides the effect of a piston: one side 22 is subjected to the pressure P of the propelling gas 16, a pressure that is communicated by the other face 24 of the plate 20 to the extinguishing agent 4 so as to authorise its expulsion from the reservoir 2. Advantageously, the walls of the reservoir are parallel in the direction in which the plate moves, for example in the form of a revolution cylinder; however, alternatives are possible, with for example a separating element comprising articulated plates. The plate 20 is refractory, one piece or structured, for example made of plastic, or any rigid material, covered with refractory material, such as an elastomer; it can move during the ejection (dotted lines), for example by means of rails on the inside wall of the reservoir 2.

The plate 20 may be "solid", which is to say that it can separate the volume of the reservoir 2 from the extinguisher 1 into two parts 26, 28 more or less leak proof or hermetic with respect to one another. In particular, a clearance may be left at the periphery of the plate 20 to allow it to move, but the exchanges only take place in this clearance.

It is advantageous for the part 26 located on the side of the ejection orifice 6 to contain just the extinguishing agent 4, and for the upper part 28 not to contain an extinguishing agent 4, especially in the case where it is a liquid: the plate 20 acts as an interface between the extinguishing agent 4 and the pressurising gas 16.

In another embodiment, the plate 20 is equipped with passages between the two parts 26, 28 that it limits, for example it is in the form of a grill. In this case, heat exchanges always occur at the surface of the extinguishing agent 4, however, they may be greatly reduced and the function of the plate 20 is satisfied. In particular, it is preferable for the porosity of the plate 20, which is to say the ratio between the surface area of its passages and its total surface area, to be around 10% to 15%.

Even though a separating element comprising a single plate 20 is described, it is possible that for each embodiment, such a plate 20 is associated for example to another rigid plate, or a flexible component.

Another embodiment relates to a separating element in the form of a membrane, which will be described in relation to another gas generation system, even though the membrane may of course be used in an extinguisher 1 of the type shown in FIG. 1.

Indeed, another embodiment relates to a gas generator 30 with a pyrotechnic cartridge. Advantageously, for reasons of size, and as illustrated in FIG. 2, the generator is inside the bottle 2; it is composed of a chamber 32 equipped with an ignition device 34, and containing a cartridge 36 with a pyrotechnic material such as propergol. The gases created by the combustion of the pyrotechnic material 36 are directed towards the bottle 2 via at least one outlet orifice 38 of the chamber 32. Such generators 30 are known to those skilled in the art.

The separating element 40 comprises in this case a flexible membrane. Advantageously, the membrane 40 acts as an interface between the extinguishing agent 4 and the pressurising gas 16, which is to say that the membrane 40 is "fitted" onto the extinguishing agent 4. The membrane is attached at its periphery at the zones of the reservoir 2, either glued or mechanically attached for example. Attachment to the middle of the reservoir 2 is possible, as shown in FIG. 2, in particular when the reservoir 2 is spherical. It may be advantageous to attach the membrane at the outlet orifice 6.

Preferably, the extensible membrane 40, is leak proof to the extinguishing agent 4, or even to the propelling gas 16 generated by the combustion of the propergol 36. The membrane is furthermore refractory. It may consist of a flexible and extensible pouch, for example made of a non reinforced elastomer material.

Depending on how the bottle 2 is filled, the membrane 40 may adjoin the generator 30 when the extinguisher 1 is at rest (FIG. 2A), a situation in which the sealing device 12, which here is a calibrated cap, is closed.

Figure 2A:
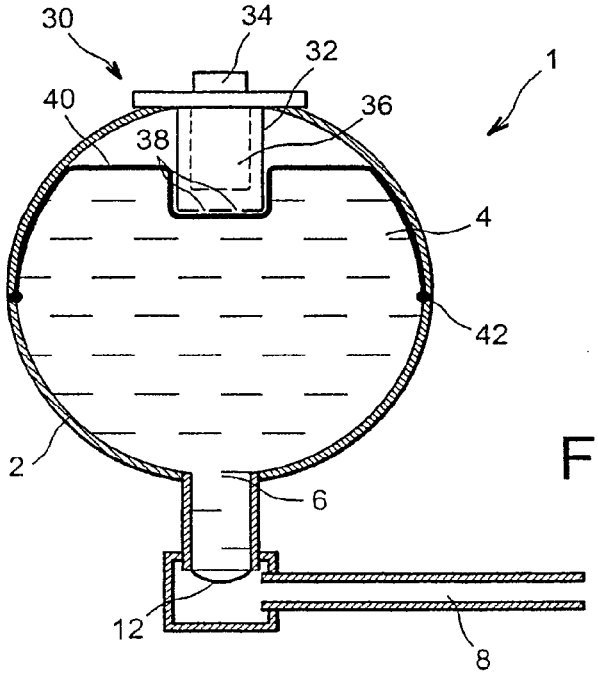
FIGS. 2A-2D show the operation of another embodiment.
Figure 2B:
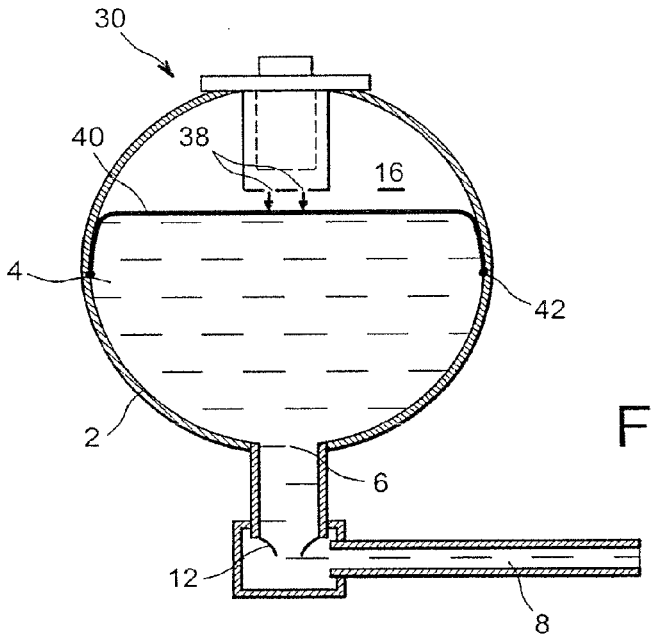
Figure 2C:
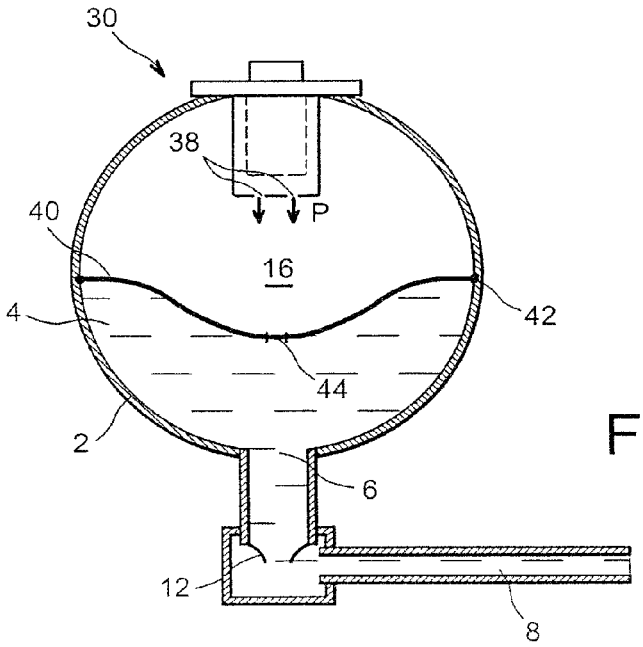
Figure 2D:
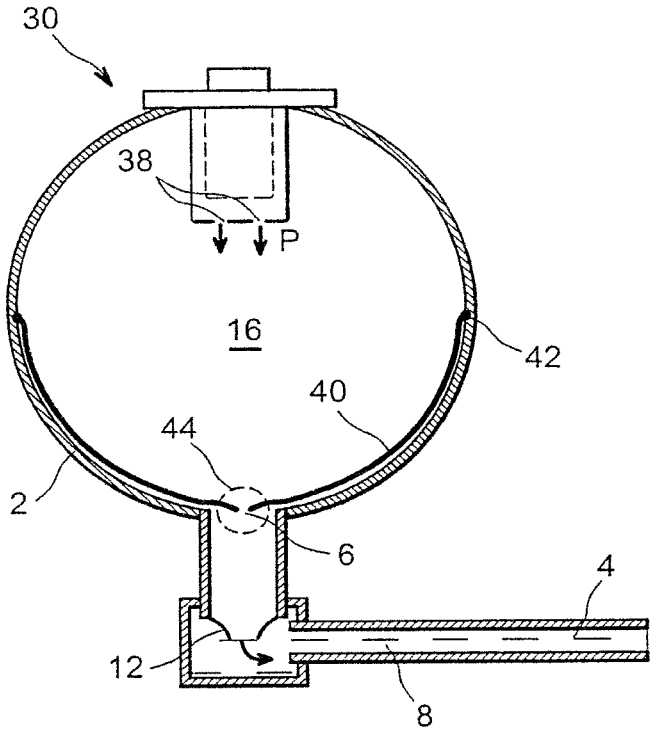

When extinction is required, the ignition device 34 ignites the propergol block 36, and the pressurised gas is evacuated by the orifice 38 to the reservoir 2. The pressure P thus created causes the calibrated protective cap 12 to open, lowers the level of the extinguishing agent 4 due to its ejection in the distribution means 8: see FIG. 2B. The drop in the level of the extinguishing agent 4 is accompanied by the movement and deformation of the membrane 40, which remains in contact with it (FIG. 2C).

When the extinguishing agent 4 has been completely ejected, it may be preferable however to continue to apply a pressure P to the extinguishing agent 4, which is then contained in the distribution tubes 8 during the entire depressurisation of the cylinder 2 in order to ensure the complete eviction of the agent 4 to the fire zone 10. One possibility is fitting, in the separation membrane 40, opening means which permit the pressurising gas 16 and the extinguishing agent 4 to be brought into contact.

In a first variant of the embodiment, the opening means 44 may comprise a fusible cap which is broken when the pressure P applied to the protective cap 44 is greater than its rupture value. In this way, the membrane 40, when the extinguisher 1 is not used, is a single part; when the propelling gas 16 is generated, the pressure in the reservoir 2 increases as well as the pressure P applied to the membrane 40 and to the cap 44, which thus remains closed. At the end of the emptying of the bottle 2 containing the extinguishing agent 4, the cap 44 is only subjected to the pressure P of the generated gas 16, given the small amount of extinguishing agent 4 that is still present: the effort exerted unilaterally on the protective cap 44 due to the pressurisation of the cylinder 2 becomes sufficient to cause its rupture.

The cap 44 may be opened when the quantity of extinguishing agent 4 in the reservoir 2 is virtually null, or there may still remain agent 4 to be ejected. In this second case, the dimension of the hole of the cap 44 is selected to be sufficiently small so that the heat exchange between the propelling gas 16 and the extinguishing agent 4 is reduced, so as to avoid modifying the propelling qualities of the agent generated. The conformed hole 44 thus allows pressure to be continuously applied to the extinguishing agent 4 contained in the tubes 8 throughout the depressurisation of the cylinder 2 thus ensuring the total eviction of the agent 4 to the fire zone 10.

Advantageously, the fusible cap 44 is located at the outlet orifice 6 when the membrane is deformed by the pressure of the gas 16 and when it is opened. It is also possible to provide a membrane 40 that is sufficiently fragile to ensure the rupture at the outlet orifice 6 when the difference in pressure between its two faces is greater than a threshold value (the rest of the membrane 40 is protected by the walls of the reservoir 2).

Another variant relates to the presence of a hole of a small diameter in the membrane 40: these opening means 44, as the grill previously, lead to a reduced heat exchange between the propelling gas 16 and the extinguishing agent 4, which does not modify the propelling qualities of the agent generated.

The presence of opening means 44 may be also envisaged when a rigid plate 20 is used as a separating element.

In both cases (safety protective cap or presence of a hole), the surface area of the opening means 44 is advantageously approximately that of the calibrated cap 12.

The description presented above naturally does not exclude all of the alternatives that those skilled in the art will not fail to observe to fulfil a purpose of the invention. In particular, various combinations are possible between the various embodiments presented, for example a membrane for a non-spherical reservoir, or a rigid plate for a generator by combustion of propergol. It is also possible to have a rigid plate associated to the cylinder walls by an elastic seal or a membrane flexible.

Furthermore, it appears obvious to those skilled in the art that these examples are purely illustrative: other means may be used following the principle of the invention, to generate a pressurised gas in order to ensure the ejection of the extinguishing agent. Chemical reactions, by mixing products for example, or pumps compressing a gas taken from the environment close by or further away from said device can also be conceived. Similarly, the forms mentioned are also purely illustrative.

The invention claimed is:

1. An extinction device, comprising:

an extinguisher reservoir including an extinguishing agent;

means for generating a pressurized gas;

communication means for creating a communication between the reservoir and the means for generating said gas so that the gas generated by the means for generating a pressurized gas penetrates into the extinguisher reservoir; and a separating element located between the communication means and the extinguishing agent, the separating element having a first side facing the extinguishing agent and a second side facing the gas, wherein the separating element comprises a refractory material on each of the first and second sides to reduce heat exchanges between the extinguishing agent and the gas generated such that pressure reduction in the reservoir caused by the extinguishing agent absorbing calories from the gas is reduced wherein the separating element comprises at least one passage orifice, and separates the reservoir into two parts which communicate via the passage orifice.

2. The device according to claim 1, wherein the separating element remains in contact with the extinguishing agent during a use of the device.

3. The device according to claim 1, wherein the separating element separates the reservoir into two leak proof parts.

4. The device according to claim 1, wherein the separating element is mobile.

5. The device according to claim 1, wherein the pressure in the reservoir of the extinguisher is ambient in the absence of generated gas.

6. The device according to claim 1, wherein the extinguishing agent is in liquid form.

7. The device according to claim 1, wherein the means of generating a pressurized gas includes at least one pressurized gas reservoir.

8. The device according to claim 1, further comprising distribution means for the extinguishing agent.

9. An extinction device, comprising:

an extinguisher reservoir including an extinguishing agent;

means for generating a pressurized gas;

communication means for creating a communication between the reservoir and the means for generating said gas so that the gas generated by the means for generating a pressurized gas penetrates into the extinguisher reservoir; and a separating element located between the communication means and the extinguishing agent, the separating element having a first side facing the extinguishing agent and a second side facing the gas, wherein the separating element comprises a refractory material on each of the first and second sides to reduce heat exchanges between the extinguishing agent and the gas generated such that pressure reduction in the reservoir caused by the extinguishing agent absorbing calories from the gas is reduced, wherein the separating element comprises opening means which permit two parts to be brought into communication wherein the separating element separates the reservoir into two leak proof parts.

10. The device according to claim 9, wherein the opening means are a fusible cap.

11. An extinction device, comprising:

an extinguisher reservoir including an extinguishing agent;

means for generating a pressurized gas;

communication means for creating a communication between the reservoir and the means for generating said gas so that the as generated by the means for generating a pressurized gas penetrates into the extinguisher reservoir; and a separating element located between the communication means and the extinguishing agent, the separating element having a first side facing the extinguishing agent and a second side facing the gas, wherein the separating element comprises a refractory material on each of the first and second sides to reduce heat exchanges between the extinguishing agent and the gas generated such that pressure reduction in the reservoir caused by the extinguishing agent absorbing calories from the gas is reduced, wherein the means for generating a pressurized gas comprise a gas generator comprising a chamber equipped with a gas outlet orifice and a cartridge with a block of pyrotechnic material that generates propelling gas.

12. The device according to claim 11, in which the chamber of the gas generator is inside the extinguisher reservoir.

13. The device according to claim 11, further comprising distribution means for the extinguishing agent.

14. The device according to claim 13, wherein the distribution means comprise a calibrated cap.

* * * * *